US009428933B2

(12) United States Patent
Simonson et al.

(10) Patent No.: US 9,428,933 B2
(45) **Date of Patent: *Aug. 30, 2016**

(54) STAKE SYSTEM AND METHOD FOR SOFT MATERIAL

(71) Applicants: Eric M. Simonson, Salt Lake City, UT (US); E. Roger Simonson, Salt Lake City, UT (US)

(72) Inventors: Eric M. Simonson, Salt Lake City, UT (US); E. Roger Simonson, Salt Lake City, UT (US)

( * ) Notice: Subject to any disclaimer, the term of this patent is extended or adjusted under 35 U.S.C. 154(b) by 321 days.

This patent is subject to a terminal disclaimer.

(21) Appl. No.: 13/826,184

(22) Filed: Mar. 14, 2013

(65) Prior Publication Data

US 2013/0192652 A1 Aug. 1, 2013

Related U.S. Application Data

(60) Continuation-in-part of application No. 13/353,637, filed on Jan. 19, 2012, now Pat. No. 8,464,738, which is a division of application No. 12/843,580, filed on Jul. 26, 2010, now Pat. No. 8,118,047.

(60) Provisional application No. 61/611,912, filed on Mar. 16, 2012.

(51) Int. Cl.
*E04H 15/62* (2006.01)
*E02D 5/80* (2006.01)

(52) U.S. Cl.
CPC ..... *E04H 15/62* (2013.01); *E02D 5/80* (2013.01)

(58) Field of Classification Search
CPC ... E04H 12/2215; E04H 15/62; E04H 15/32; E04H 17/22; E02D 5/80; E02D 5/803; A01K 1/04
USPC ..... 135/118, 119, 120.4, 95, 905; 52/155–157, 163, 165–166, 148; 119/780–782, 786–787; 405/244, 405/259.1, 302.2; 248/530, 532, 533, 156, 248/508
See application file for complete search history.

(56) References Cited

U.S. PATENT DOCUMENTS

| | | | | |
|---|---|---|---|---|
| 412,766 | A | 10/1889 | Lounsberry | |
| 928,469 | A | 7/1909 | Miles | |
| 1,034,109 | A * | 7/1912 | Harrison | 52/155 |
| 1,105,884 | A | 8/1914 | Crites | |
| 1,121,772 | A * | 12/1914 | Spanier | 52/155 |
| 1,724,688 | A | 8/1929 | Wickstrum | |
| 2,712,864 | A | 7/1955 | Clevett, Jr. | |
| 3,080,024 | A | 3/1963 | Clevett | |
| 3,139,163 | A | 6/1964 | Haller | |
| 3,242,623 | A | 3/1966 | Brisse | |
| 3,431,924 | A | 3/1969 | Simpson | |
| 3,758,062 | A | 9/1973 | Caldwell et al. | |
| 3,766,878 | A | 10/1973 | Hogue | |
| 3,788,336 | A | 1/1974 | Steffes | |
| 3,814,118 | A | 6/1974 | Larson | |
| 3,867,733 | A | 2/1975 | Verlander | |

(Continued)

*Primary Examiner* — Winnie Yip
(74) *Attorney, Agent, or Firm* — David L. Stott

(57) ABSTRACT

A stake system and method configured to be used in substantially loose material to anchor an object are provided. In one embodiment, the stake system includes a flexible line and a stake member having an elongated portion and a distal portion. One end of the flexible line couples to the distal portion of the stake member. The distal portion of the stake member and the flexible line are driven into the loose material. The flexible line is moved to extend tautly from the distal portion and through the loose material at an angle such that an end of the flexible line above the loose material couples to the object.

29 Claims, 9 Drawing Sheets

(56) References Cited

U.S. PATENT DOCUMENTS

| | | | | |
|---|---|---|---|---|
| 4,003,169 | A | 1/1977 | Young, II | |
| 4,063,567 | A | 12/1977 | Martin et al. | |
| 4,337,717 | A | 7/1982 | Gregory | |
| 4,363,198 | A | 12/1982 | Meyer | |
| D270,365 | S | 8/1983 | Hawk | |
| 4,738,063 | A | 4/1988 | Alsop | |
| 4,831,798 | A | 5/1989 | Otteson | |
| 4,832,304 | A | 5/1989 | Morgulis | |
| 4,905,718 | A | 3/1990 | Vandiver | |
| 4,953,576 | A | 9/1990 | Connelly | |
| 5,085,281 | A * | 2/1992 | Selly | 173/91 |
| 5,122,014 | A | 6/1992 | Genfan | |
| 5,123,779 | A | 6/1992 | Miller | |
| 5,171,108 | A * | 12/1992 | Hugron | 405/259.1 |
| 5,175,966 | A | 1/1993 | Remke et al. | |
| 5,226,829 | A | 7/1993 | Jones | |
| 5,322,386 | A | 6/1994 | Trangsrud | |
| 5,396,743 | A | 3/1995 | Bellette | |
| 5,461,833 | A * | 10/1995 | Murray et al. | 52/155 |
| 5,463,834 | A * | 11/1995 | Krieger | 52/155 |
| 5,662,134 | A | 9/1997 | Auer | |
| 5,699,864 | A | 12/1997 | Dvorak et al. | |
| 5,988,194 | A | 11/1999 | Collins | |
| 6,238,143 | B1 * | 5/2001 | Zablonski | 405/259.1 |
| 6,301,830 | B1 | 10/2001 | Whipple | |
| 2003/0024460 | A1 | 2/2003 | Militello | |
| 2004/0099300 | A1 | 5/2004 | Warren | |
| 2005/0016574 | A1 * | 1/2005 | Holub | 135/118 |
| 2005/0217188 | A1 | 10/2005 | Burns | |

* cited by examiner

STAKE SYSTEM AND METHOD FOR SOFT MATERIAL

CROSS-REFERENCE TO RELATED APPLICATIONS

The present application claims the benefit of U.S. Provisional Application No. 61/611,912, filed on Mar. 16, 2012. This application also claims benefit to, and is a continuation-in-part of U.S. patent application Ser. No. 13/353,637, filed on Jan. 19, 2012, which is pending and which is a divisional of U.S. application Ser. No. 12/843,580, filed on Jul. 26, 2010, now issued as U.S. Pat. No. 8,118,047. The disclosures of each application listed above are incorporated by reference herein in their entireties.

TECHNICAL FIELD

The present invention relates generally to an anchor or a stake and, more specifically, to stake systems, devices, and methods for anchoring objects in loose material, such as sand or snow.

BACKGROUND

Prior-art stakes have generally taken the shape of large nails or pegs for various objects to be anchored, such as for tents, sun shades, tarps, etc. The attachment point for such stakes is at the top or top portion of the stake. In mild weather conditions, these prior-art stakes generally secure the object successfully if secured in compacted or somewhat solid soils despite heavy wind conditions. However, in loose, non-compacted sandy soils or sand the prior art stakes completely fail in even the most mild wind conditions. Similar failures occur when anchoring an object in snow. To overcome the issues of anchoring in non-compact material, such as sand or snow, longer stakes have been employed or stakes with auger type ends to provide reinforcement in the non-compact material. Such structures, however, are bulky, costly to manufacture, and add considerable weight to the stake itself, resulting in stakes that are impractical and, with unpredictable weather conditions, will simply not provide sufficient anchoring resistance in such non-compact material.

Therefore, based on the foregoing, it would be advantageous to provide a light-weight stake with a minimal footprint that is cost efficient to manufacture and provides considerable anchoring force in loose, non-compacted material, such as sand or snow.

BRIEF SUMMARY OF THE INVENTION

The present invention is directed to a stake system and method configured to be used in substantially loose material to anchor an object. In accordance with one embodiment, the stake system includes a stake member and a flexible line. The stake member includes an elongated portion and a distal portion. The distal portion is integrally formed with the elongated portion. The distal portion defines a first lateral width and the elongated portion defines a second lateral width, the first lateral width being larger than the second lateral width. The flexible line is configured to be coupled to the stake member. The flexible line and the distal portion of the stake member are configured to be below the exposed surface of the loose material. The flexible line is sized and configured to cut through the loose material such that at least a portion of the flexible line extends tautly away from the stake member and through the loose material below the exposed surface. Further, the flexible line includes an end configured to extend above the loose material to couple to the object. With this arrangement, the stake member is configured to substantially maintain a constant orientation relative to the exposed surface of the loose material upon the stake member being forced into the loose material and upon the flexible line being extended tautly away from the stake member at an angle ranging between about 45 degrees and about 135 degrees.

In one embodiment, the stake member includes a continuous bend that extends along both the elongated portion and the distal portion thereof and extends along a longitudinal length of the stake member. In another embodiment, the stake member includes multiple openings defined therein that extend through the stake member such that the multiple openings are aligned along the bend in both the distal portion and the elongated portion. Further, the multiple openings may be elongated openings and configured to couple to the flexible line. Furthermore, the flexible line is configured to couple to the stake member by extending through at least two of the openings. In another embodiment, the flexible line is configured to selectively extend through two of at least three of the multiple openings to provide a selective effective force applied to the stake member.

In another embodiment, the stake member includes multiple coupling portions aligned along a center longitudinal axis extending along both the distal portion and the elongated portion of the stake member. In one embodiment, the flexible line includes a first line portion and a second line portion, the first line portion and the second line portion each extending from separate and distinct coupling portions of said multiple coupling portions. Further, in another embodiment, the first line portion and the second line portion are configured to selectively couple to two of at least three of the multiple coupling portions to provide a selective effective force applied to the stake member.

In yet another embodiment, the stake member is configured to be positioned in the loose material such that the bend orients the distal portion and the elongated portion to extend away from the end of the flexible line coupled to the object. In another embodiment, a portion of the flexible line is configured to nest in the bend defined in the stake member.

In another embodiment, the flexible line includes a coupling member sized and configured to engage an opening defined in the distal portion of the stake member. Such a coupling member may include a first opposing portion and a second opposing portion with a middle portion extending therebetween, wherein the middle portion is configured to engage the opening and the first and second opposing portions are configured to be positioned at opposing sides of the stake member. In one embodiment, the coupling member includes a key configuration that corresponds to the opening defined in the distal portion of the stake member.

In another embodiment, the stake member tapers along a longitudinal length thereof from a distal portion of the stake member toward a proximal end of the stake member.

In yet another embodiment, the stake system may include a load amplifier configured to be positioned in the loose material such that the flexible line is configured to be operatively coupled to and tautly extend from the load amplifier.

In accordance with another embodiment of the present invention, a stake system is configured to be used in substantially loose material to anchor an object. The stake system includes a stake member and a flexible line. The stake member includes an elongated portion and a distal portion, the distal portion being integrally formed with the elongated portion. The distal portion is configured to maintain a fixed position relative to the elongated portion and, further, the distal portion includes a width larger than the elongated portion. The flexible line is configured to be coupled to the stake member. The flexible line and the distal portion of the stake member are configured to be below the exposed surface of the loose material. The flexible line is sized and configured to cut through the loose material such that at least a portion of the flexible line extends tautly away from the stake member and through the loose material below the exposed surface. The flexible line includes an end configured to extend above the loose material to couple to the object, and the flexible line is configured to extend tautly away from the stake member and through the loose material at an angle ranging between about 45 degrees and about 135 degrees.

In one embodiment, the stake member includes a continuous bend that extends along both the elongated portion and the distal portion thereof and extends along a longitudinal length of the stake member. In another embodiment, the stake member is configured to be positioned in the loose material such that the bend orients the distal portion and the elongated portion to extend away from the end of the flexible line coupled to the object.

In accordance with another embodiment of the present invention, a high-load stake system is configured to be used in substantially loose material to anchor an object. The high-load stake system includes a stake member, a flexible line and a load amplifier. The stake member includes a longitudinal length and includes an elongated portion and a distal portion. The distal portion is configured to maintain a fixed position relative to the elongated portion, and the distal portion includes a lateral width larger than the elongated portion. The flexible line is configured to be coupled to the distal portion of the stake member. The flexible line and the distal portion of the stake member are configured to be driven below a surface of the loose material. Further, the flexible line is sized and configured to cut through the loose material such that at least a portion of the flexible line extends tautly away from the stake member and through the loose material below the surface. The flexible line includes an end configured to extend above the surface of the loose material, and the flexible line is configured to extend tautly away from the stake member and through the loose material at an angle ranging between about 45 degrees and about 135 degrees. The load amplifier extends between a first end portion and a second end portion, the first end portion configured to be positioned above the loose material and the second end portion configured to be driven into the loose material. The load amplifier includes a first line and a second line. The first line is configured to extend tautly from the first end portion to couple to the end of the flexible line. The second line is configured to extend away from the stake member and is configured to extend toward and couple to the object.

In one embodiment, the load amplifier includes a spade portion coupled to the second end portion of the load amplifier. The spade portion is configured to be driven into the loose material. Further, the spade portion may include a surface area configured to stabilize the load amplifier in the loose material. In another embodiment, the load amplifier includes a step portion configured to facilitate driving the spade portion into the loose material. Such a step portion extends laterally from the load amplifier and extends separately and discreetly from the spade portion. In another embodiment, the load amplifier includes an elongated member extending between the first end portion and the second end portion.

In accordance with another embodiment of the present invention, a method of anchoring an object in loose material is provided. The method includes forcing a distal portion and a portion of an elongated portion of a stake member in the loose material, the distal portion integrally formed with the elongated portion, while simultaneously forcing a flexible line coupled to the distal portion of the stake member. The method also includes pulling an end of the flexible line so that the flexible line tautly cuts through the loose material toward the object with the end exposed above the loose material. In addition, the method also includes coupling the end of the flexible line to the object for anchoring the object with the distal portion having a width larger than the elongated portion such that the stake member is configured to substantially maintain a constant orientation relative to the exposed surface of the loose material so that the flexible line extends from the stake member at an angle ranging between about 45 degrees and about 135 degrees.

In one embodiment, the method includes selectively coupling the flexible line to two of at least three coupling positions on the stake member. The method step of selectively coupling includes threading the flexible line through two separate and distinct openings defined in the stake member. Further, the method step of selectively coupling may include selecting an effective force vector for extending toward the object between a first line portion and a second line portion of the flexible line. In another embodiment, the method step of coupling comprises coupling a first coupling member and a second coupling member of the first line portion and the second line portion, respectively, of the flexible line to the object.

In accordance with another embodiment of the present invention, a method of anchoring an object to loose material is provided. The method includes forcing a spade portion of load amplifier into the loose material with an end portion of the load amplifier positioned above the surface of the material; forcing a distal portion and a portion of an elongated portion of a stake member in the loose material at a position spaced from the load amplifier, the distal portion integrally formed with the elongated portion, while simultaneously forcing a flexible line coupled to the distal portion of the stake member into the loose material; coupling an end of the flexible line left above a surface of the loose material to a first line extending from the end portion of the load amplifier; and coupling a second line to the object so that the second line extends away from the stake member and between the load amplifier and the object.

In one embodiment, the method further includes tautly extending the flexible line and the first line between the distal portion of the stake member and the end portion of the load amplifier. In another embodiment, the method includes anchoring a force placed on the second line with both the load amplifier and the stake member.

In another embodiment, the step of forcing the distal portion and the portion of the elongated portion of the stake member also includes the step of orienting the stake member to substantially maintain a constant orientation relative to the surface of the loose material so that the flexible line extends from the stake member at an angle ranging between about 45 degrees and about 135 degrees. In another embodiment, the method also includes pulling the end of the flexible line so that the flexible line tautly cuts through the loose material toward the end portion of the load amplifier.

In accordance with another embodiment of the present invention, another stake system configured to be used in substantially loose material to anchor an object is provided. The stake system includes a stake member and a rigid member. The stake member includes a stake member and a rigid member. The stake member includes an elongated portion and a distal portion that extends along a longitudinal length of the stake member. The distal portion is integrally formed with the elongated portion. Further, the distal portion is configured to maintain a fixed position relative to the elongated portion, and the distal portion includes a width larger than the elongated portion. The rigid member is configured to be pivotably coupled to the distal portion of the stake member. The rigid member and the distal portion of the stake member are configured to be below an exposed surface of the loose material. The rigid member is sized and configured to pivot through the loose material such that at least a portion of the rigid member extends away from the stake member and through the loose material below the exposed surface. The rigid member includes an end configured to extend above the loose material to couple to the object. Further, the rigid member is configured to extend away from the stake member and through the loose material at an angle ranging between about 45 degrees and about 135 degrees.

In one embodiment, the rigid member comprises at least one of a metallic material and a polymeric material. In another embodiment, the stake member is configured to be positioned in the loose material with the rigid member extending along the stake member in a closed position and, upon the rigid member being pivoted relative to the stake member such that the rigid member extends away from the stake member at the angle. In yet another embodiment, the stake member includes a bend formed therein and extending along the longitudinal length of the stake member.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
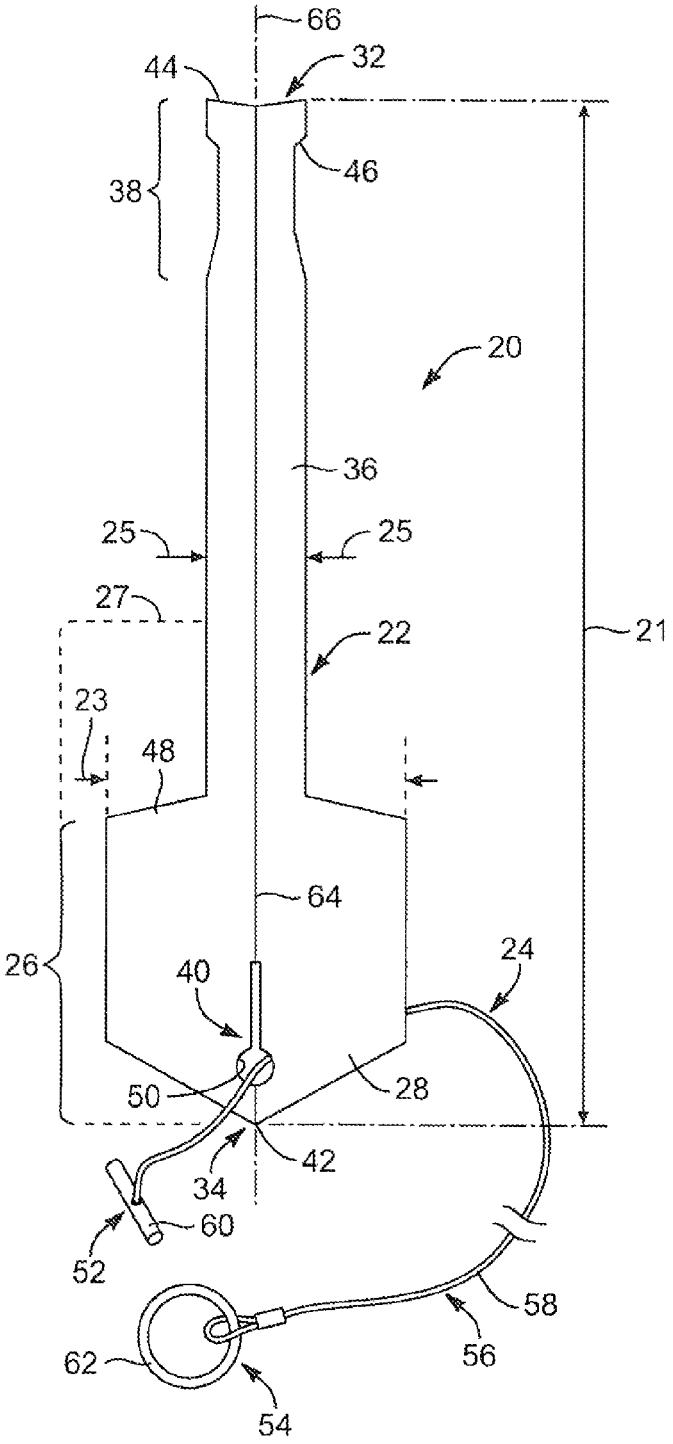
FIG. 1 is a front view of a stake system having an elongate member and a flexible line, according to an embodiment of the present invention.
Figure 4A:
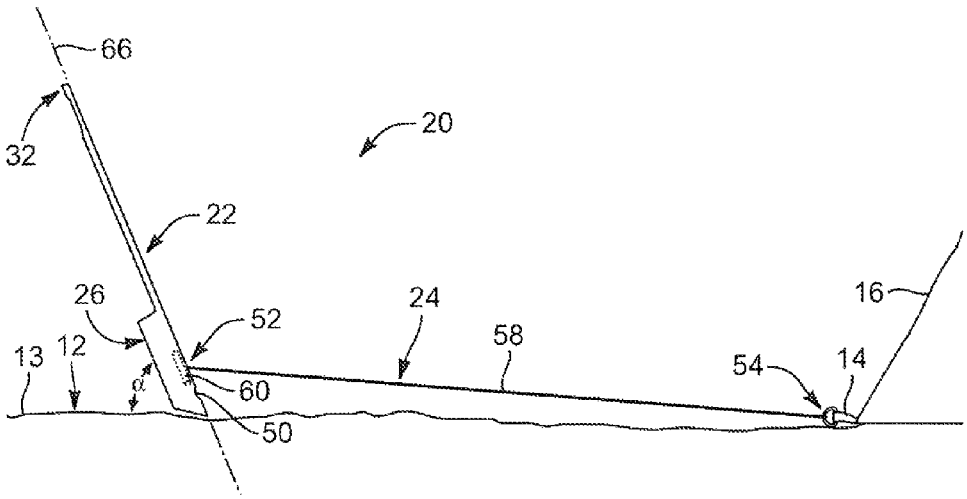
FIG. 4A is a side view of the stake system and a stake-down object, depicting the elongate member and flexible line disposed above a loose material in a pre-use position, according to one embodiment of the present invention.
Figure 4B:
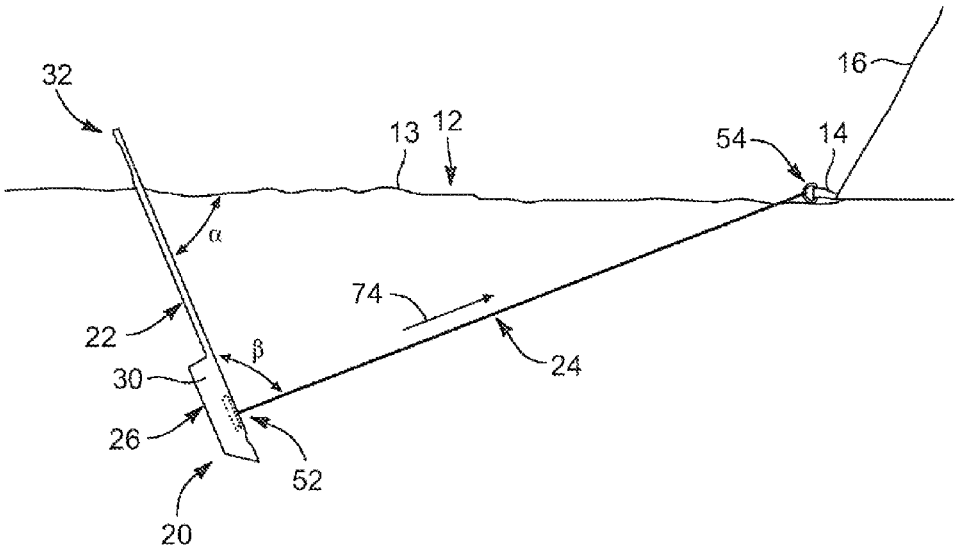
FIG. 4B is a side view of the stake system and a stake-down object, depicting the elongate member and flexible line disposed within the loose material in a use position, according to another embodiment of the present invention.

Referring to FIGS. 1 and 4B, an anchoring or stake system 20 is shown. Such a stake system 20 may include an elongate member 22 (or otherwise termed a stake or anchor) and a flexible line 24. The stake system 20 may be configured to provide anchoring resistance for a stake-down object 16 in soft or loose material 12, such as sand or sandy soils. Other soft or loose materials 12 may include snow or any other soft or loose material, such as gravel, loose dirt, or other fine aggregate. The stake-down object 16 or objects that may be employed with the stake system 20 of the present invention may include tents, tarps, trees, shrubs, sun shades, boats or snow/ice climbing devices that may need to be anchored in loose material 12, as set forth above, or any other object that may be anchored in loose material 12. As shown in the drawings and as described throughout the following description, as is traditional when referring to relative positioning on an object, the term "proximal" refers to the end portion of the apparatus which is closer to the user and the term "distal" refers to the end portion of the apparatus which is further from the user in the normal use of such apparatus. For example, relative to the elongate member 22 or stake disclosed herein, the proximal end portion of the elongate member 22 is the portion that a user would strike with a hammer and the distal end portion of the elongate member is the portion that may include a spike end, or the like, that is driven below the surface of the ground.

The stake system 20 disclosed herein may be termed a deep anchoring system that, as previously set forth, may include the elongate member 22 and the flexible line 24. Such a flexible line 24 may be sized and configured to be coupled to the elongate member 22 at a distal portion 26 thereof. The distal portion 26 of the elongate member 22, with the flexible line 24 coupled thereto, may be configured to be pounded or forced into a soft or loose material 12, for example, sand. Due to the loose nature of sand, the flexible line 24 can cut through the sand such that the coupled end and a portion of the flexible line 24 extend away from the elongate member 22 through the sand and toward the object being staked down. The other end of the flexible line 24 may be exposed above the sand to attach or couple to the stake-down object 16 for example, a tent. Such coupling to the stake-down object 16 may include directly coupling to a tie-down 14 or a guy-line. With this arrangement, the flexible line 24 extending through the loose material and being coupled to the distal portion 26 of the elongate member 22 provides a deep anchoring system with greater pull-out resistance than that of conventional stakes so as to facilitate anchoring in loose material 12, such as sand.

Figure 2:
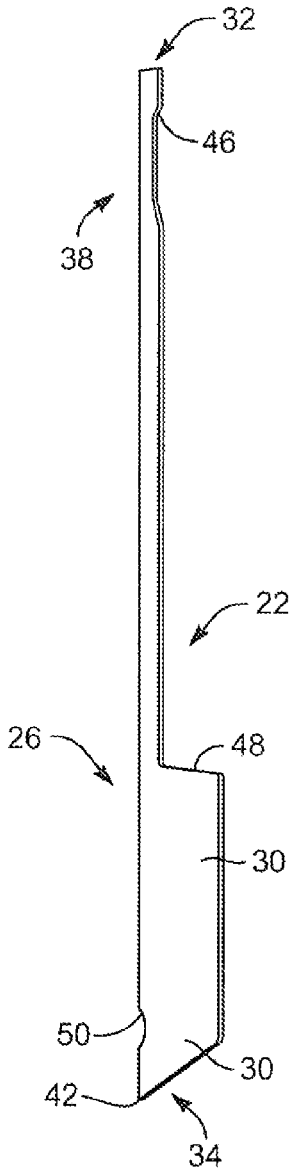
FIG. 2 is a side view of the elongate member of the stake system, according to the present invention.
Figure 3:
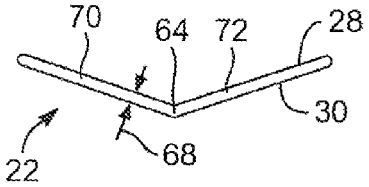
FIG. 3 is an end view of the elongate member of the stake system, according to the present invention.

With reference to FIGS. 1 through 3, in one embodiment, the elongate member 22 may include a first side surface 28 and a second side surface 30 each extending along a longitudinal length 21 and a width of the elongate member 22. The longitudinal length 21 may extend between a proximal end 32 and a distal end 34 of the elongate member 22. The width of the elongate member 22 may vary along one or more portions of the longitudinal length 21 of the elongate member 22. The elongate member 22 may include the distal portion 26, an intermediate extension 36 and a proximal portion 38. In one embodiment, the distal portion 26 may extend between about a midpoint 27 of the elongate member 22 to the distal end 34 of the elongate member 22, the midpoint 27 being defined as one-half the longitudinal length 21 of the elongate member 22. The distal portion 26 may include a coupling portion 40 sized and configured to couple to the flexible line 24. Further, the distal portion 26 may include a distal point 42 along an end surface of the distal portion 26, the distal point 42 configured to be initially forced in the ground or loose material 12. In another embodiment, the end surface or distal end 34 may be flat, without the distal point.

The intermediate extension 36 may extend various lengths between the distal portion 26 and the proximal portion 38 depending on the desired length of the elongate member 22. The proximal portion 38 may include a proximal end surface 44 configured to be pounded or forced downward and may be left exposed above the ground or loose material 12. The proximal portion 38 may also define one or more notches 46 to facilitate pulling the elongate member from the ground for removal therefrom.

In one embodiment, the distal portion 26 may include a lateral extension 48, extending laterally relative to the longitudinal length 21, similar to a paddle or wing configuration. The lateral extension 48 may provide a first width 23 that is greater than a second width 25 at the intermediate extension 36 of the elongate member 22. The lateral extension 48 may include various forms and may include an enlarged surface area per unit length relative to the intermediate extension 36 such that the first width 23 of the lateral extension 48 is greater than the second width 25 immediately proximal the lateral extension 48.

The distal portion 26 of the elongate member 22, as previously set forth, may include the coupling portion 40. In one embodiment, such a coupling portion 40 may be in the form of an opening 50 defined in the elongate member 22 and extending therethrough. The opening 50 may define a circular shape with a slot extending therefrom. Such an opening 50 may be sized and configured to reversibly couple with one end of the flexible line 24. Other coupling configurations may be employed, as known to one of ordinary skill in the art. For example, the coupling portion 40 may be in the form of a protrusion or hook that may latch or couple to a looped end (not shown) of the flexible line 24. The coupling between the flexible line 24 and the elongate member 22 may also be a permanent coupling so that the flexible line 24 remains fixed to the elongate member 22. Importantly, the flexible line 24 should be coupled to the elongate member 22 at a position along the length of the elongate member 22 that positions the flexible line 22 within the loose material 12. In one embodiment, the coupling portion 40 may be distal to at least the midpoint 27 of the elongate member 22. In other words, the flexible line 24 may couple to the elongate member 22 at any point between the midpoint 27 and the distal end 34 of the elongate member 22.

The flexible line 24 may include a first end 52 and a second end 54 with an intermediate portion 56 therebetween. In one embodiment, the flexible line 24 may include a line 58 with a coupling member 60 at the first end 52 and another coupling element, such as a ring 62 at the second end 54. The ring 62 at the second end 54 of the flexible line 24 may be employed to couple to a tie-down 14 or a guy-line of, for example, a tent or any other suitable stake-down object 16, as previously set forth. The coupling member 60 may be rod-like or a cylindrical like member with one end of the line 58 connected thereto. To couple the first end 52 of the flexible line 24 to the elongate member 22, one end of the coupling member 60 may be inserted through the circular shaped portion of the opening 50 with the line 58 so that the line 58 may slide up the slot portion of the opening 50. With this arrangement, the flexible line 24 may then be pulled tautly to bias or seat the coupling member 60 against a first side surface 28 of the distal portion 26 of the elongate member 22, thereby, coupling the first end 52 of the flexible line 24 to the elongate member 22. It should be noted that although a rod-like coupling member 60 may be used other shapes for a coupling member 60 may also be used such as a sphere shaped member or a disc shaped member or any other suitable coupling member known in the art, some of which may be employed with different shaped openings 50 defined in the distal portion 26 of the elongate member 22.

The line 58 of the flexible line 24 may be made from a metal or high-strength polymer material or a combination of both, or any other suitable material that is flexible and relatively thin that can cut through soft or loose material 12, such as sand or snow, The line 58 can be wire-like and may be braided into a cable like structure or be made from a single high-strength and flexible line. Other materials for the line 58 may also be employed as known to one of ordinary skill in the art.

In another embodiment, the elongate member 22 may define a bend 64 along the longitudinal length 21 of the elongate member 22. The bend 64 may extend along the entire length or along a portion of the length, such as along the distal portion 26 of the elongate member 22. Further, the bend 64 may extend along an axis 66 or center line of the elongate member 22 and along the longitudinal length 21. The bend 64 in the first side surface 28 of the distal portion 26 of the elongate member 22 may be employed to seat the coupling member 60 against or within the bend 64 when the flexible line 24 is pulled taut, thereby, centering the coupling member 60 relative to the elongate member 22. As known by one of ordinary skill in the art, other structures may be employed without departing from the spirit and scope of the present invention that centers or aligns the flexible line 24, upon being placed in a taut position, relative to the elongate member 22.

As depicted in FIG. 3, an end it of the elongate member 22 is shown. The first side surface 28 of the elongate member 22 may be the surface facing upward and the second side surface 30 may be the surface facing downward. The second side surface 30 of the elongate member 22 may define a peak at the bend 64 and along the distal portion 26 or along the length of the elongate member 22. The elongate member 22 may include a substantially flat structure defining a depth dimension 68 between the first side surface 28 and the second side surface 30. In an embodiment with the bend 64, such bend 64 may define a first side 70 (left side) and a second side 72 (right side) of the elongate member 22.

In another embodiment, the elongate member 22 may define a lateral bend (not shown) that extends laterally relative to the axis 66 of the elongate member 22. For example, a lateral bend may be employed to further stabilize the elongate member 22, such as including a bend extending lateral to the longitudinal length 21 in, for example, the proximal portion 38 of the elongate member such that, in the use position, a proximal portion exposed above the loose material extends away from the direction of the flexible line. In this manner, the proximal portion of the elongate member may be employed as a pounding surface at the bend, the elongate member being forced into the loose material until the proximal portion that is bent is flush with the loose material. The proximal portion of the elongate member being flush with the loose material may further increase the pull-out resistance with an underside of the bent proximal portion having leverage against the surface of the loose material.

In one embodiment, the elongate member may be made from aluminum, steel, stainless steel, titanium or composites or combinations thereof or any other suitable metals or combination of metals or composites. In another embodiment, the elongate member may be made from a polymeric material of types known in the art. The elongate member may be manufactured utilizing known processes of fabrication and/or molding, such as stamping, laser cutting or injected molding in the case of employing a polymeric elongate member or any other known polymeric molding process, as known to one of ordinary skill in the art.

FIGS. 4A and 4B depict the stake system 20 of the present invention being employed within the loose material 12, such as sand, for anchoring a stake-down object 16, such as a tent. With respect to FIG. 4A, a user of the stake system 20 may couple the second end 54 of the flexible line 24 to a tie-down 14 of the stake-down object 16. The user may then couple the first end 52 of the flexible line 24 to the elongate member 22 so that the coupling member 60 (shown in outline form) is positioned within the bend (not shown) on the first side surface 28 of the elongate member 22 and the line 58 is positioned at a top-end of the slot of the opening 50 defined in the distal portion 26 of the elongate member 22. The elongate member 22 may then be positioned a distance away from the tie-down 14 so that the flexible line 24 is taught. Also, the elongate member 22 may be oriented relative to a surface 13 of the loose material 12 at an angle $\alpha$. The angle $\alpha$ may range between about 20 degrees to about 90 degrees, however, other angles may also be acceptable as the more important component in the deep anchoring system is the angle from which the flexible line 24 extends from the elongate member 22, discussed in detail below with respect to FIG. 4B.

Further, with respect to FIG. 4A, when pulling the elongate member 22 to place the flexible line 24 in the taut position, care should be taken that the second side surface 30 of the elongate member 22 is oriented to face the tie down 14 at the angle $\alpha$ or, in other words, the elongate member 22 should not be skewed or rotated relative to axis 66 of the elongate member 22 when placing the elongate member 22 in the orientation prior to forcing the elongate member 22 into the loose material 12. At this stage, a user may then place their knee or foot on the flexible line 24 at, or adjacent to, the second end 54 thereof to maintain the tautness of the flexible line 24 while forcing the elongate member 22 into the loose material 12. The user may then employ a hammer or mallet to force or drive the elongate member 22 into the loose material 12 by pounding on the proximal end 32 of the elongate member 22.

As depicted in FIG. 4B, the taut flexible line 24 is configured to cut through or slice through the loose material 12 as the elongate member 22 is driven into the loose material 12. In the final use-position, the flexible line 24 may extend directly away from the elongate member 22 toward the stake-down object 16 at an angle $\beta$. The angle $\beta$ is defined as the angle between the elongate member 22 and the flexible line 24 when the stake system 20 is in the use position. For maximum performance, the angle $\beta$ may be preferably about 90 degrees. Other angles for angle $\beta$ that provide acceptable resistance may range between about 60 degrees and about 120 degrees. Further, other angles for angle $\beta$ that may be employed may range between about 45 degrees and about 135 degrees. In this manner, the stake system 20, including the flexible line 24 coupled to the distal portion 26 of the elongate member 22, acts as a deep anchoring system that provides a pull-force resistance allowing one to readily anchor in loose material 12, such as sand. Further, the surface area of the lateral extensions 48 and the second side surface 30 of the elongate member 22 that is concealed or below the exposed surface 13 of the loose material 12 provides resistance from being pulled through the loose material 12 with a directional force 74 provided through the taught flexible line 24 being placed on the elongate member 22 at the distal portion 26 thereof and adjacent the lateral extensions 48 below the surface of the loose material 12. Furthermore, in another embodiment, the bend (not shown) along the length and axis 66 of the elongate member 22 may automatically center and orient the second side surface 30 of the elongate member 22 relative to the directional force 74 in the taut flexible line 24. Proper orientation of the second side surface 30 relative to the flexible line 24 may increase the pull-through resistance of the elongate member 22 due to maximizing the surface area of the second side surface 30 of the elongate member 20 facing the directional force 74 of the flexible line 24. In this manner, the preferred angle β is about 90 degrees, but other angles may also provide acceptable resistance, as previously set forth. With this arrangement, the stake system 20, including the elongate member 22 and flexible line 24, may be employed in loose material 12 to anchor a stake-down object 16.

Furthermore, in another embodiment, the stake system may be employed by attaching the second end of the stake-down object after forcing the elongate member into the loose material. For example, the first end 52 of the flexible line 24 may be coupled to the distal portion 26 of the elongate member 22. The elongate member 22 may then be forced into the loose material 12 by, for example, pounding on the proximal end 32 with a mallet, with a portion of the flexible line 24 also being forced into the loose material 12. The user can then pull the second end 54 of the flexible line 24 toward the tie-down 14 of the stake-down object 16, thereby, pulling the flexible line 24 taut to cut or slice through the loose material 12 to extend in the direction of the tie-down 14. The user can then couple the second end 54 of the flexible line 24 to the stake-down object 16 with a portion of the flexible line extending through the loose material, as depicted in FIG. 4B.

Figure 5:
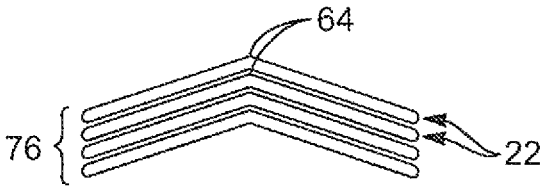
FIG. 5 is an end view of multiple elongate members in a compact, nested arrangement, according to another embodiment of the present invention.

With reference now to FIG. 5, in another embodiment, the elongate member 22 may include the bend 64, as previously set forth, along at least a portion of the longitudinal length of the elongate member 22 to readily facilitate a nested arrangement 76 with other elongate members 22. As depicted, a plurality of elongate members 22 may be nested together to allow a user to maintain the plurality of elongate members 22 together with a minimal foot-print. Such minimal foot-print facilitates greater portability in maintaining the plurality of elongate members 22 in a compact manner or the nested arrangement 76.

Figure 6:
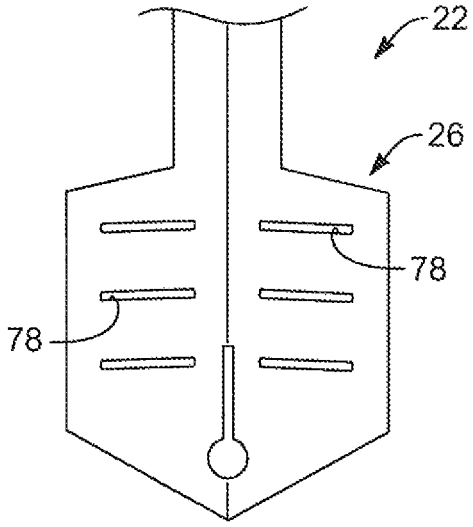
FIG. 6 is a partial front view of an elongate member with multiple slots defined in the elongate member, according to another embodiment of the present invention.

In another embodiment, with respect to FIG. 6, the distal portion 26 of the elongate member 22 may include one or more secondary openings 78 defined therein. The secondary openings 78 may extend through the elongate member 22 and may be in the form of, for example, slots within the elongate member 22 or any other suitable shaped secondary openings 78. In one embodiment, the secondary openings 78 may extend laterally relative to the longitudinal length of the elongate member 22. In another embodiment, the secondary openings 78 may extend vertically or diagonally relative to the longitudinal length of the elongate member 22. In still another embodiment, the secondary openings 78 may be circular or oval holes or define a curve-linear slot within the elongate member 22.

The secondary openings 78 may be useful for being employed in loose material, such as snow. In particular, for example, upon the elongate member 22 being forced in a loose material, such as snow, the snow may melt so that water may collect within and along the secondary openings 78 and then turn to ice. The ice within and along the secondary openings 78 may provide an increase in the pull-through resistance. In this manner, the elongate member 22 may include one or more secondary openings 78 in the distal portion 26 and/or along other portions of the elongate member 22 to maximize the potential pull-through resistance of the elongate member 22.

Figure 7:
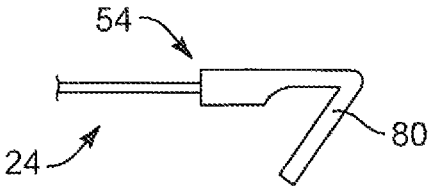
FIG. 7 is an enlarged side view of one end of the flexible line, according to another embodiment of the present invention.
Figure 8:
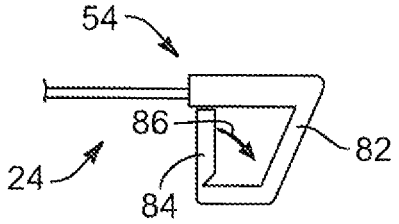
FIG. 8 is an enlarged side view of one end of the flexible line, according to another embodiment of the present invention.

With respect to FIGS. 7 and 8, other embodiments are shown that may be employed at the second end 54 of the flexible line 24 to couple to a tie-down 14 (or guy-line) or coupled directly to a stake-down object 16 (see FIG. 4A). For example, FIG. 7 illustrates a hook structure 80 that may be fixed at the second end 54 of the flexible line 24. FIG. 8 shows a latch structure 82 fixed at the second end 54 of the flexible line 24. The latch structure 82 may include an extension 84 that pivots, as depicted by arrow 86. As known by one of ordinary skill in the art, other suitable structures may be utilized for coupling to a stake-down object.

Figure 9:
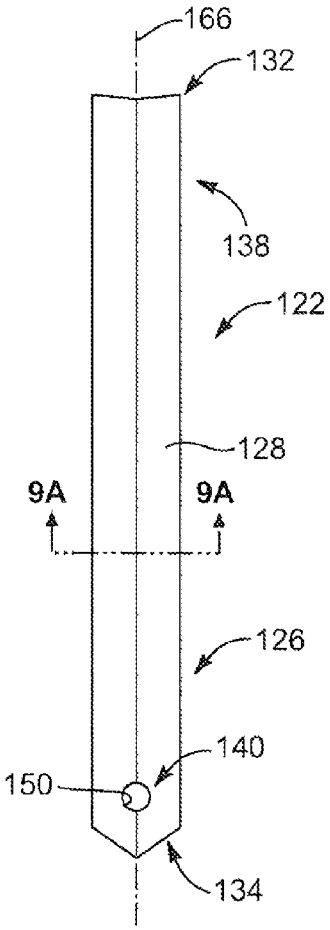
FIG. 9 is a front view of an elongate member, according to another embodiment of the present invention.
Figure 9A:
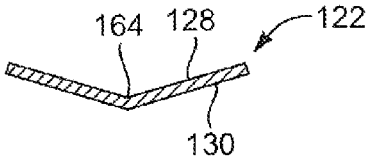
FIG. 9A is an enlarged cross-sectional view taken along section line 9A of FIG. 9, according to the present invention.

With reference to FIGS. 9 and 9A, another embodiment of an elongate member 122 is shown, FIG. 9A being a cross-sectional view taken along section line 9A of FIG. 9. In this embodiment, the elongate member 122 is similar to the embodiment depicted in FIG. 1, except in this embodiment, the elongate member 122 may include a substantially constant width along the longitudinal length. The elongate member 122 may include a first side surface 128 and a second side surface 130 extending between a proximal end 132 and a distal end 134 with a bend 164 along an axis 166 or center line of the elongate member 122. Further, the elongate member 122 may include a coupling portion 140 defined as an opening 150 in distal portion 126 of the elongate member 122 sized and configured to couple with the flexible line (not shown), similar to that described previously. Further, a proximal portion 138 of the elongate member 122 may include notches (not shown) along one or both sides of the elongate member 122 to facilitate pulling the elongate member 122 from the loose material, such as the sand.

Figure 10:
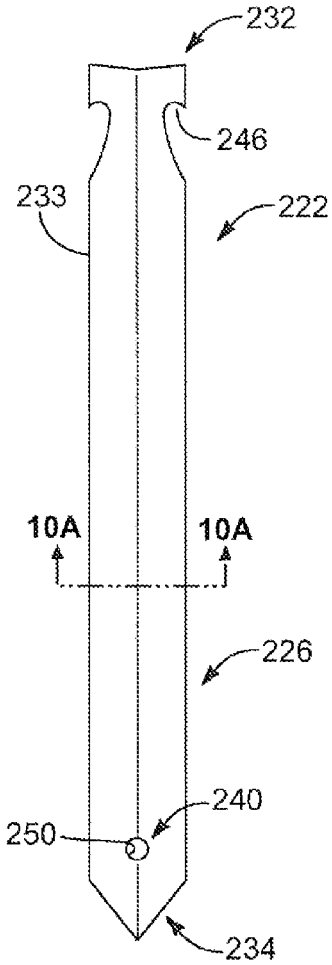
FIG. 10 is a front view of an elongate member, according to another embodiment of the present invention.
Figure 10A:
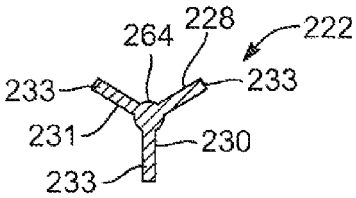
FIG. 10A is a cross-sectional view taken along section line 10A of FIG. 10, according to the present invention.

With reference to FIGS. 10 and 10A, another embodiment of an elongate member 222 is shown, FIG. 10A being a cross-sectional view of the elongate member 222 taken along section line 10A of FIG. 10. The elongate member 222, in this embodiment, may include a tri-wing configuration or a "Y" configuration, as depicted in FIG. 10A. As such, the elongate member 222 may include a first side surface 228, a second side surface 230 and a third side surface 231 each defined by ribs 233 that may extend between a proximal end 232 and a distal end 234 along the longitudinal length of the elongate member 222 and extend laterally relative to a longitudinal axis of the elongate member 222. As in the previous embodiments, the elongate member 222 may include a coupling portion 240 or opening 250 defined in a distal portion 226 of the elongate member 222. Such opening 250 may be sized and configured to receive a first end of a flexible line (not shown) so that, for example, a coupling member (not shown) may be disposed within a bend 264 in the first side surface 228 to center and align the elongate member 222 when being forced into the loose material, as previously discussed herein. Adjacent to the proximal end 232, the elongate member 222 may include notches 246 defined in the ribs 233 to facilitate pulling the elongate member 222 from the loose material. Further, in another embodiment, the distal portion 226 may include a lateral extension (not shown) such that the ribs 233 extend laterally to enlarge the surface area of the distal portion 226 (similar to the lateral extension 48 depicted in FIG. 1).

Figure 11:
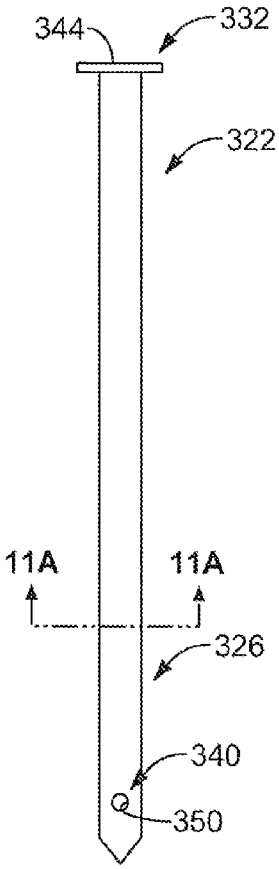
FIG. 11 is a front view of an elongate member, according to another embodiment of the present invention.
Figure 11A:
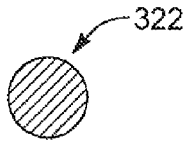
FIG. 11A is a cross-sectional view taken along section 11A of FIG. 11, according to the present invention.

Referring now to FIGS. 11 and 11A, another embodiment of an elongate member 322 is shown. In this embodiment, the elongate member 322 may include a circular cross-section, shown in FIG. 11A, taken from section line 11A of FIG. 11. Similar to previous embodiments, the elongate member 322 of this embodiment may include a coupling portion 340 or opening 350 defined in a distal portion 326 of the elongate member 322 for coupling to a flexible line (not shown). At a proximal end 332 of the elongate member 322, the elongate member 322 may include a proximal end surface 344 sized and configured to receive pounding for forcing the elongate member 322 into the loose material to place the elongate member 332 and flexible line in the use-position. This embodiment may also include a lateral extension (not shown) or wing configuration at the distal portion 326 of the elongate member 322.

Figure 12:
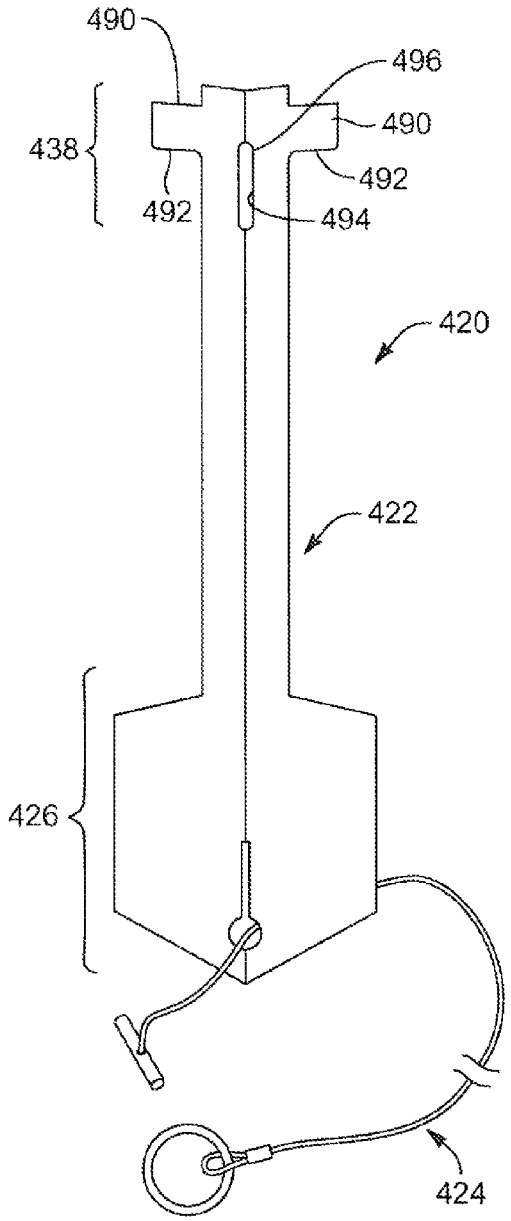
FIG. 12 is a front view of a stake system with an elongate member and a flexible line depicting the elongate member having a T-configuration at a proximal portion thereof, according to another embodiment of the present invention.

With respect to FIG. 12, another embodiment of the stake system 420 is shown. This embodiment is similar to the previous embodiments and more specifically to the embodiment depicted and described relative to FIG. 1. However, in this embodiment, the elongate member 422 or stake may include a T-configuration at a proximal portion 438 thereof. As in the previous embodiments, the stake system 420 of this embodiment may include the elongate member 422 and a flexible line 424, the flexible line 424 configured to be coupled to the distal portion 426 of the elongate member 422. In this embodiment, the proximal portion 438 of the elongate member 422 may include the T-configuration or one or more proximal lateral tabs 490. The tabs 490 may extend laterally relative to the longitudinal length of the elongate member 422 at the proximal portion 438 of the elongate member 422 to define an under-side surface 492 of the tab. Further, the elongate member 422 may include a hole 494 defined in the elongate member 422 at the proximal portion 438 of the elongate member 422. The hole 494 may extend through the depth of the elongate member 422 to include a hole periphery 496 defined in the elongate member 422. The hole 494 may be sized and configured to receive one of the lateral tabs 490 of another elongate member 422. For example, when it is desired to remove the stake system 420 from the ground, the hole 494 defined in the elongate member 422 may be exposed above ground level to allow a user to insert the tab 490 of another elongate member 422 into the hole 494 to abut the under-side surface 492 of the tab 490 against the hole periphery 496. The user can then pull upward, thereby, pulling the stake system 420 from the ground. In this manner, the tab 490 and hole 494 arrangement in the proximal portion 438 of the elongate member 422 may be employed to more easily remove the stake system 420 from the ground. Alternatively, the stake system 420 may be removed from the ground (without the above-described hole) by placing the under-side surface 492 of one elongate member 422 under the under-side surface 492 of another elongate member 422 that is partially exposed in the ground for leverage therebetween. The user can then readily pull the partially exposed elongate member from the ground via the tabs 490 of the two elongate members 422.

Figure 13:
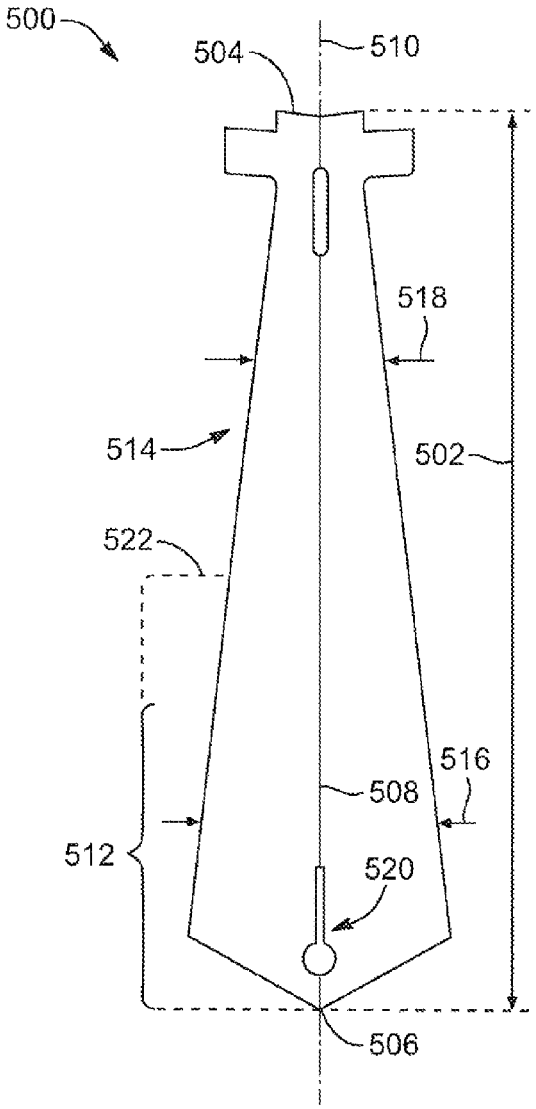
FIG. 13 is a front view of a stake member with an elongate portion and a distal portion, according to another embodiment of the present invention.

Referring now to FIG. 13, another embodiment of a stake member 500 that may be employed with a flexible line (not shown) as a stake system, similar to that described and depicted in previous embodiments. The stake member 500 of this embodiment may include a longitudinal length 502 extending between a proximal end 504 and a distal end 506. Further, the stake member 500 may include a bend 508 along the longitudinal length 502 and a center line 510 or axis of the stake member 500. Also, the stake member 500 includes a distal portion 512 proximate to the distal end 506 and an elongated portion 514 longitudinally extending between the distal portion 512 and the proximal end 504, the elongated portion 514 being integrally formed with the distal portion 512.

In this embodiment, the elongated portion 514 may laterally widen in width toward the distal portion 512. In other words, the stake member 500 may taper in width from the distal portion 512 toward the proximal end 504. Further, as in previous embodiments, the distal portion 512 of this embodiment includes a first lateral width 516 and the elongated portion 514 includes a second lateral width 518, the first lateral width 516 being larger than the second lateral width 518. In addition, the distal portion 512 includes a coupling portion 520 defined therein to facilitate coupling to the flexible line (not shown). Such a distal portion 512 may extend proximate the coupling portion 520 and/or may extend from a mid-point 522 of the stake member toward the distal end 506 of the stake member 500. As depicted, in this embodiment, both the distal portion 512 and the elongated portion 514 may taper in their respective lateral widths. In another embodiment, the taper may extend from the distal portion of the stake member, but only along the elongated portion 514 of the stake member 500.

As in previous embodiments, the stake member 500, including the distal portion 512 and at least a portion of the elongated portion 514, is configured to be forced and positioned into a loose material with the proximal end 504 configured to remain exposed above a surface of the loose material. Further, the stake member 500 is configured to substantially maintain a constant orientation relative to the exposed surface of the loose material upon the stake member 500 being forced into the loose material and upon the flexible line (not shown) being extended tautly away from the stake member 500 at an angle ranging between about 45 degrees and about 135 degrees, as described in previous embodiments.

Figure 14:
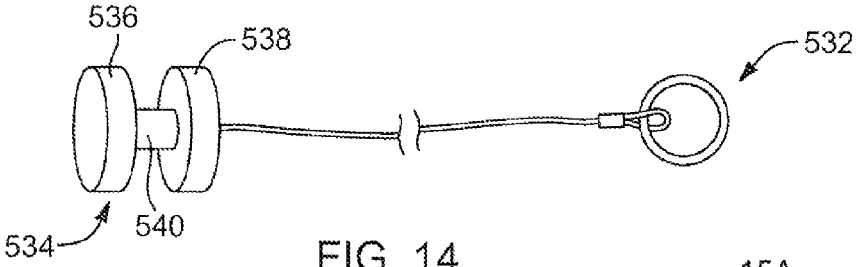
FIG. 14 is a perspective side view of a coupling member at one end of a flexible line, according to another embodiment of the present invention.
Figure 14A:
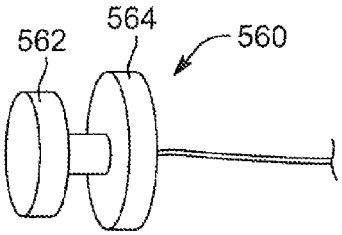
FIG. 14A is a partial perspective view of an alternative coupling member at one end of a flexible line, according to another embodiment of the present invention.
Figure 15:
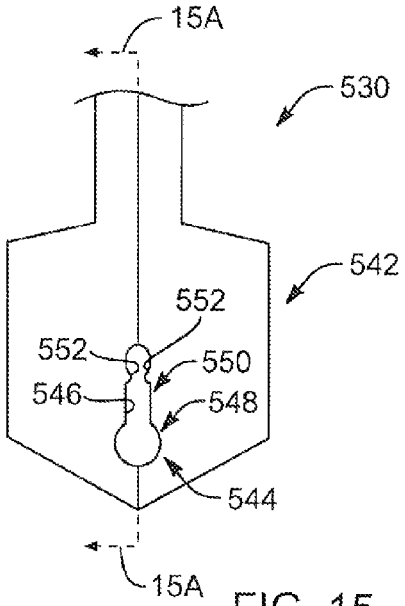
FIG. 15 is a front view of a distal portion of a stake member, depicting a coupling portion defined in the stake member, according to another embodiment of the present invention.

With respect to FIGS. 14 and 15, another embodiment of a flexible line 532 and stake member 530, respectively, are provided. The flexible line 532 of this embodiment provides a coupling member 534 having a first opposing portion 536 and a second opposing portion 538 with a middle portion 540 extending therebetween. The stake member 530 includes a distal portion 542 with a coupling portion 544 that may be in the form of an opening 546 defined through the distal portion 542 of the stake member 530. Such an opening 546 may include a first portion 548 and a second portion 550. The first portion 548 of the opening 546 may include circular shape and the second portion 550 of the opening 546 may include an elongate shape that extends proximally from the circular first portion 548. The elongate second portion 550 may include two opposing nubs 552 configured to engage the middle portion 540 of the coupling member 534 and configured to maintain the middle portion 540 of the coupling member 534 within the coupling portion 544 of the stake member 530. In this manner, the first opposing portion 536 of the coupling member 534 may be sized and configured to be inserted through the circular first portion 548 of the coupling portion 544. Further, the middle portion 540 may be sized and configured to slide proximally along the second portion 550 to squeeze beyond the two opposing nubs 552 and to be held or removably locked above the nubs 552. The first opposing portion 536 and the second opposing portion 538 may include a circular or disc shaped configuration with the middle portion 540 having a cylindrical configuration. As can be readily appreciated by one of ordinary skill in the art, the first and second opposing portions 536, 538 may include a variety of geometries that correspond with profile geometry of the first portion 548 of the coupling portion 544. The coupling member 534 may be made of a rigid or semi-rigid material. Such material may be a metallic material, such as aluminum or steel, or polymeric material, such as a plastic or rubber material, or any other suitable material or combination of materials. Further, the flexible line 532 may extend through or partially into the coupling member 534. In one embodiment, the first opposing portion 536 and the second opposing portion 538 may be similarly sized. In another embodiment, as depicted in FIG. 14A, a coupling member 560 may include a first opposing portion 562 and a second opposing portion 564 that include different sizes or diameters. With this arrangement, the first opposing portion 562 may be sized and configured to be inserted through a first portion 548 of the coupling portion 544 of the stake member 530 (See FIG. 15) and the second opposing portion 564 may be sized larger than the first opposing portion 562 to minimize the potential of the coupling member 560 from inadvertently disengaging from the coupling portion 544 of the stake member 530.

Figure 15A:
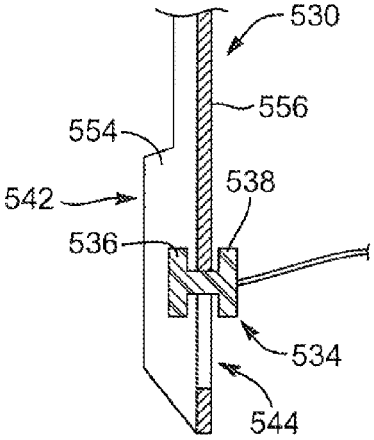
FIG. 15A is a cross-sectional view of the stake member, taken along section line 15A of FIG. 15, depicting the coupling member engaged with the coupling portion of the stake member, according to another embodiment of the present invention.

With respect to FIG. 15A (also with reference to FIGS. 14 and 15), a cross-sectional view of the coupling member 534 engaged with the stake member 530 is provided. As depicted, the coupling member 534 may be engaged to the coupling portion 544 of the stake member 530. For example, the first opposing portion 536 may be inserted through the circular first portion 548 of the coupling portion 544 with the middle portion 540 forced proximally along the elongate second portion 550 to be forced beyond or past the nubs 552 and maintained in the proximal most portion of the elongate second portion 550 of the coupling portion 544. Further, at this stage, the first opposing portion 536 may be positioned adjacent and/or against a first side surface 554 of the stake member 530 and the second opposing portion 538 may be positioned adjacent and/or against a second side surface 556 of the stake member 530. With this arrangement, the coupling member 534 may be sized and configured to be maintained and coupled to the stake member 530 to substantially prevent the coupling member 534 from incidentally being disengaged from the distal portion 542 of the stake member 530.

Figure 16:
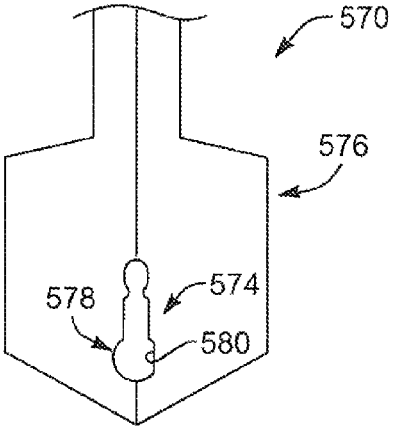
FIG. 16 is a front view of the distal portion of the stake member, depicting an alternative embodiment of the coupling portion, according to the present invention.
Figure 16A:
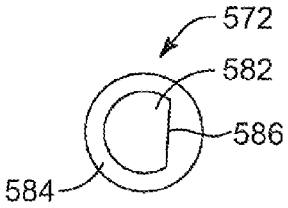
FIG. 16A is an end view of a coupling member that corresponds with the coupling portion of the stake member depicted in FIG. 16, according to another embodiment of the present invention.

Now referring to FIGS. 16 and 16A, another embodiment of a stake member 570 and a coupling member 572, respectively, is provided. In this embodiment, the stake member 570 may include a coupling portion 574 defined in the distal portion 576 thereof that may include a key configuration. For example, the first portion 578 of the coupling portion 574 may include a circular configuration defining a flat portion 580 on one side thereof. Similarly, the coupling member 572 may include a first opposing portion 582 and a second opposing portion 584, the first opposing portion 582 having a circular configuration with a flat side 586. Such first opposing portion 582 with its flat side 586 is sized and configured to correspond with the first portion 578 of the coupling portion 574 such that the first opposing portion 582 of the coupling member 572 must be oriented appropriately to be inserted through the first portion 578 of the coupling portion 574 of the stake member 570. With this arrangement, the coupling member 572 may include a key configuration to substantially minimize the coupling member 572 from disengaging from the stake member 570. Other key configurations may also be employed, such as the first opposing portion 582 having a protrusion (not shown) or the like that corresponds with the first portion 578 of the coupling portion 574 of the stake member 570.

Figure 17:
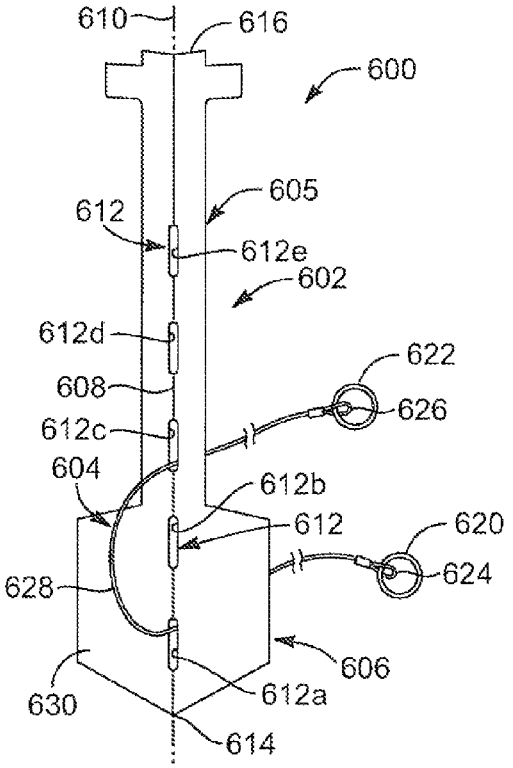
FIG. 17 is a front view of a stake system, according to another embodiment of the present invention.
Figure 18:
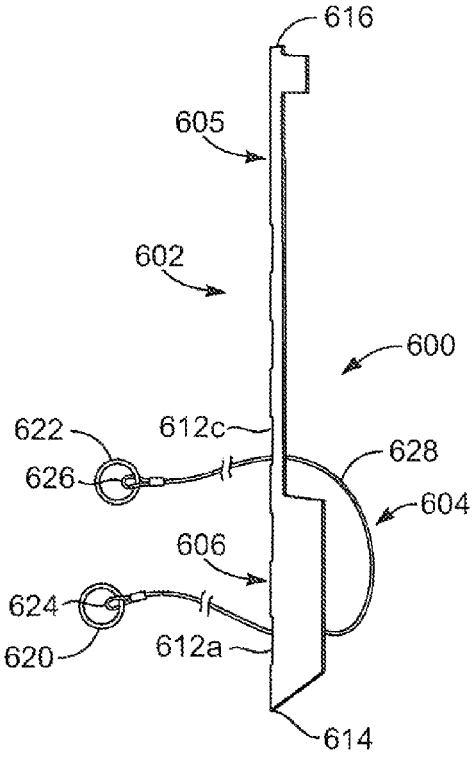
FIG. 18 is side view of the stake system of FIG. 17, according to one embodiment of the present invention.
Figure 19:
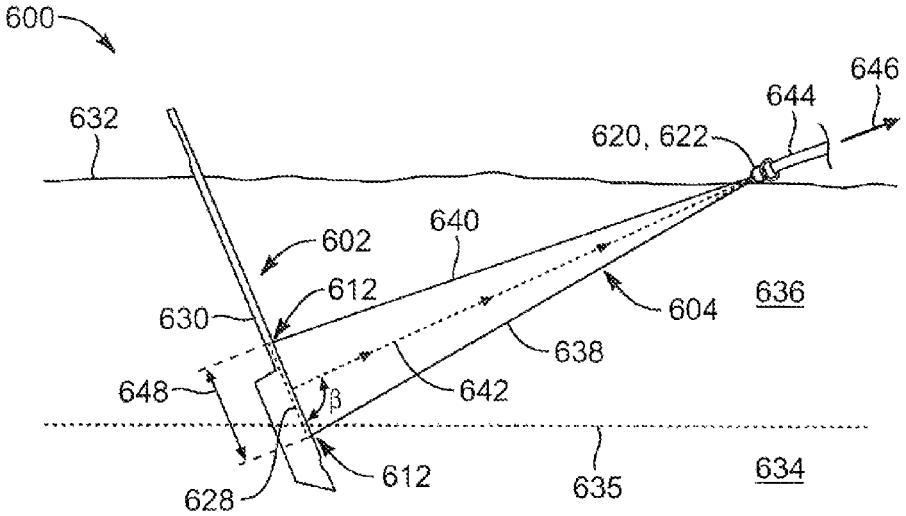
FIG. 19 is side view of the stake system of FIG. 17 in an intended use position, depicting the stake system positioned in loose material and coupled to an object, according to one embodiment of the present invention.

With respect to FIGS. 17 through 19, another embodiment of a stake system 600 is provided. This embodiment may be particularly suited as a stake system 600 to be employed in a loose material 632 where the material may be inconsistent along its depth. For example, various depths or layers of snow often provide soft or powdery portions and more rigid or icy portions, resulting in inconsistencies along the depth of the snow or loose material 632. The stake system 600 of this embodiment provides a means by which the position where an effective force is applied to the stake member 602 may be selectively modified or adjusted to more effectively anchor and address various depth inconsistencies in the snow or loose material. Further, the stake system 600 of this embodiment prevents a flexible line 602 from inadvertently becoming disengaged with the stake member 602 due to such inconsistencies in snow.

Referring first to FIGS. 17 and 18, the stake system 600 is substantially similar in its use and function of the stake systems depicted and described in previous embodiments, For example, the stake system 600 may include a stake member 602 and a flexible line 604, the stake member including an elongated portion 605 and a distal portion 606. The distal portion 606 may include a larger surface area per unit length than the surface area of the elongated portion 605 per unit length of the stake member 602. Further, the stake member 602 may include a bend 608 along the longitudinal length and center line 610 of the stake member. However, in this embodiment, the stake member 602 may include a selective coupling mechanism for coupling the flexible line 604 thereto. For example, the stake member 602 may include multiple openings 612 defined therein that extend through the stake member 602. The openings 612 may be elongated and extend longitudinally along the center line 610 of the stake member 602 and extend along the bend 608 defined in the stake member 602. The multiple openings 612 may include a first opening 612*a*, a second opening 612*b*, a third opening 612*c*, a fourth opening 612*d*, and a fifth opening 612*e*, as sequentially ordered from a distal end 614 toward the proximal end 616 of the stake member 602.

The flexible line 604 or cable may include a first coupling member 620 and a second coupling member 622 at a first end 624 and a second end 626, respectively, of the flexible line 604. In one embodiment, at least one of the first and second coupling members 620, 622 may be in the form of a ring or a loop formed at opposite ends of the flexible line 604. The flexible line 604 may be coupled to the stake member 602 by threading, for example, the first coupling member 620 through the first opening 612*a* and threading the second coupling member 622 through, for example, a third opening 612*c* so that an intermediate portion 628 of the flexible line 604 is positioned on a back-side or a first side surface 630 of the stake member 602 and, when the first and second ends 624, 626 are pulled taut, the intermediate portion 628 sits or nests within the bend 608 along the centerline 610 of the stake member 602.

With respect to FIG. 19, the stake system 600 of this embodiment is depicted in an intended use position in the loose material 632, such as snow. Similar to previous embodiments, the stake member 602 may be pushed into the loose material 632 and the flexible line 604 may be pulled tautly to cut through the loose material 632 to the location of a coupling portion 644 coupled to an object (not shown), such as a tent or any other desired object. As such, the stake system 600 may be configured to anchor the object in loose material and withstand a force 646 that may be applied to the stake system 600. As depicted, the flexible line 604, in this embodiment, may include a first portion 638 and a second portion 640 extending tautly from the stake member 602 with the first coupling member 620 and the second coupling member 622 exposed above a surface of the loose material 632 and, further, with the intermediate portion 628 positioned against the first side surface 630 of the stake member 602 against the concave side of the bend (as shown in outline). The first and second coupling members 620, 622 may both be coupled to the coupling portion 644 coupled to an object.

The force 646 placed upon the first portion 638 and the second portion 640 of the flexible line 604 provides an effective force vector 642 (shown in outline) disposed between the first portion 638 and second portion 640 of the flexible line 604. Such effective force vector 642 preferably may extend from the stake member 602 at an angle β of about 90 degrees, but may also be within the range of about 60 degrees and 120 degrees, or within the range of about 45 degrees and 120 degrees. Further, the intermediate portion 628 of the flexible line provides leverage against the stake member 602 over a length 648 between, for example, the first opening 612*a* and the third opening 612*c* (see FIG. 17) threaded by the flexible line 604. Depending upon the multiple openings 612 employed for threading the flexible line 604, the effective force vector 642 may vary in position, however, such effective force vector 642 will always extend between the first and second portions 638, 640 of the flexible line 604. Preferably, the flexible hue 604 may be threaded through the distal most opening or first opening 612*a* and, depending upon the consistency or layers of the loose material 632 will depend on which other opening the flexible line 604 is threaded. In some instances, it may be preferable to employ openings 612 other than the distal most opening.

For example, a user may select which openings 612 to thread the flexible line 604 by testing the snow. Such testing may be employed by shoveling a portion of the snow away to observe and determine the characteristics of the snow, such as observing a powder layer 634 and a rigid layer 636 (layers distinguished by dotted line 635). Once the depths of various layers in the snow are determined, the user may select particular openings 612 to thread the flexible line 604 based on the various layers and then test the anchoring force with the selected openings 612. The user may modify the two openings 612 employed and experiment with the anchoring force until the user is satisfied with the optimal selection of two openings. Some factors a user may use to determine optimal selection of openings 612 may include ensuring the effective force vector 642 extends through a rigid layer 636 of snow or ensuring the distal portion 606 of the stake member 602 engages a rigid layer 636. Once the user has selected the two openings 612 for optimal anchoring force relative to inconsistencies in the loose material 632, the user may then implement the stake system 600 for anchoring an object appropriately. In this manner, the flexible line 604 being threaded through two openings of the stake member 602 increases the stability of the stake member 602 in potentially inconsistent portions of snow and, further, prevents the potential of the flexible line 604 becoming decoupled due to such inconsistencies.

Figure 20:
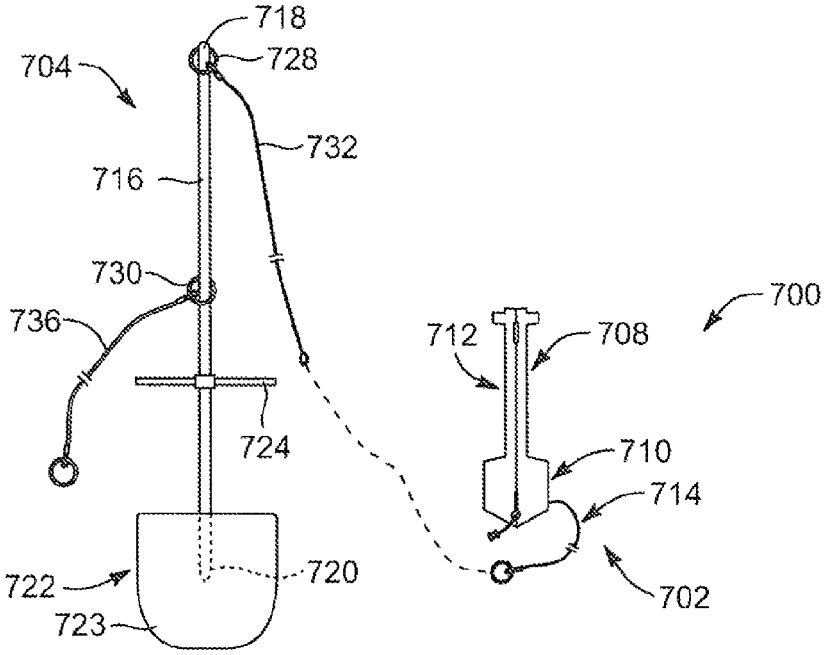
FIG. 20 is a front view of various components of a high-load stake system, according to an embodiment of the present invention.
Figure 21:
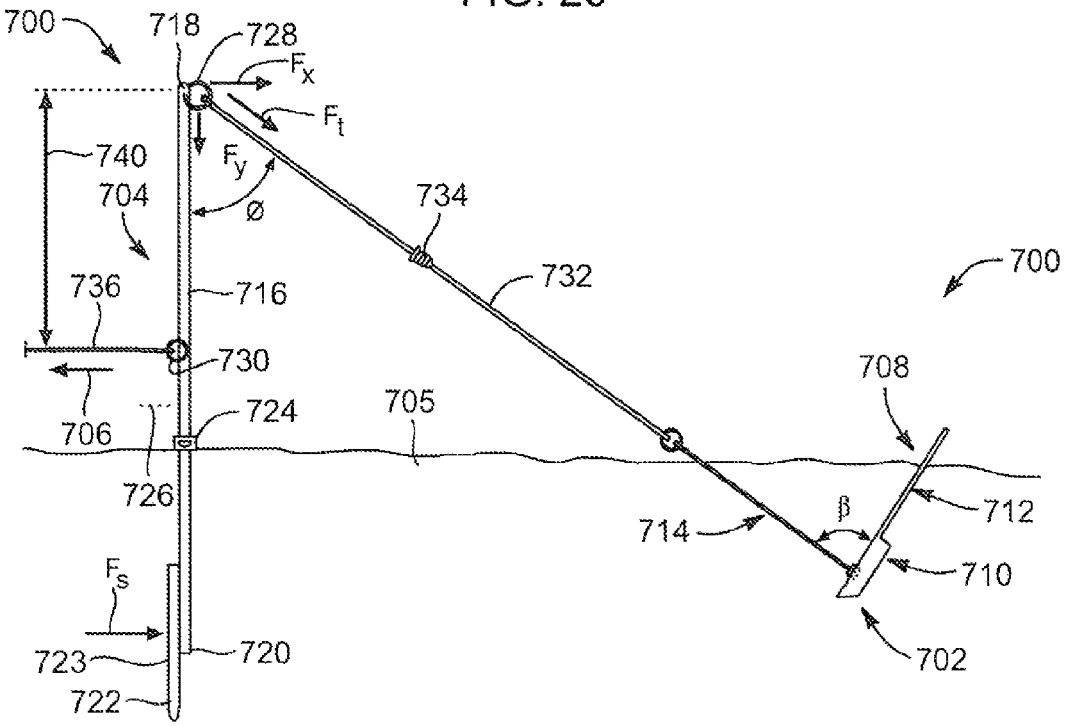
FIG. 21 is a side view of the high-load stake system in an intended use position, depicting a stake system and a load amplifier each positioned in loose material, according to an embodiment of the present invention.

Now turning to FIGS. 20 and 21, an embodiment of a high-load stake system 700 is provided. In this embodiment, the high-load stake system 700 employs a stake system 702, as described and depicted in any of the previous embodiments, with a load amplifier 704 or object to withstand a force 706. With respect to FIG. 20, the stake system 702 includes a stake member 708 having a distal portion 710 and an elongated portion 712 with a flexible line 714 coupled to the distal portion 710 of the stake member 708.

The load amplifier 704 may include an elongated pole portion 716 extending between a proximal end 718 and a distal end 720. The distal end 720 may include a spade portion 722 fixed thereto. Such a spade portion 722 may include a shovel-like configuration and a surface area 723 sized and configured to be forced deep into loose material 705 and to stabilize the load amplifier 704 in the loose material 705. The load amplifier 704 may also include a step portion 724 having an elongate configuration extending across or transverse relative to the elongated pole portion 716. The step portion 724 may be positioned distal a mid-point 726 of the elongated pole portion 716 and proximal the spade portion 722 or above and separate from the spade portion 722.

The load amplifier 704 may also include a first coupling portion 728 and a second coupling portion 730 positioned, separately and discreetly, along the elongated pole portion 716. For example, the first coupling portion 728 may be positioned a distance 740 from the second coupling portion 730 along the elongated pole portion 716. The first coupling portion 728 may be positioned at the proximal end 718 of the elongated pole portion 716. The first coupling portion 728 may be configured to include a first line 732, such as a tension strap, with a tightening buckle 734 that is configured to extend between the first coupling portion 728 and the flexible line 714 of the stake system 702. The second coupling portion 730 may be positioned between the proximal end 718 of the elongated pole portion 716 and the step portion 724. In one embodiment, the second coupling portion 730 may be positioned closer to the step portion 724 than the proximal end 718 of the elongated pole portion 716. The second coupling portion 730 may be configured to include a second line 736, the second line 736 being configured to couple to an object (not shown).

With respect to FIG. 21, the load amplifier 704 employed with the stake system 702 is depicted. For example, the load amplifier 704 may be driven into loose material 705, such as sand or snow or any other loose aggregate, by stepping on the step portion 724 or pounding the elongated pole portion 716 at its proximal end 718 to facilitate forcing the spade portion 722 below the surface of the loose material 705 until the step portion 724 is about flush with the surface of the loose material 705. Such load amplifier 704 may be vertically driven into the loose material 705 at a substantially orthogonal angle relative to the surface of the loose material 705. The first line 732 may then be attached or coupled to one end of the flexible line 714 of the stake system 702 while the other end of the flexible line 714 is coupled to a distal portion 710 of the stake member 708. The stake member 708 of the stake system 702 may then be driven into the loose material 705, as described in previous embodiments, such that the flexible line 714 extends from the stake member 708 through the loose material 705 at an angle β of about 90 degrees, or at an angle β within the range of about 60 degrees and 120 degrees, or at an angle β within the range of about 45 degrees and 135 degrees. The first line 732 may then be tensioned with the tightening buckle 734 such that the first line 732 and flexible line 714 extend tautly between the proximal end 718 of the load amplifier 704 and the distal portion 710 of the stake member 708 to provide a tension force Ft therebetween. It should be noted that this tension force Ft is facilitated via the stake system arrangement with the flexible line 714 being drawn from the distal portion 710 of the stake member 708, as previously depicted and described herein. The second line 736 may then be coupled to an object (not shown) so that the load amplifier 704 and the stake system 702 may anchor the object and withstand a force 706 applied thereto. For example, the load amplifier 704 and the stake system 702, in combination, may be employed in sand or snow for vehicle retrieval, house boat anchoring, slack line anchoring, and any other object that potentially generates large constant and/or dynamic threes. Depending on the object and the potential forces that may be generated, it may be desirable to employ additional stake systems 702, such as two or three stake systems, each with their own first line 732 extending between the proximal end 718 of the load amplifier 704 and the flexible line 714 of each stake system 702.

The load amplifier 704 and stake system 702 are sized and configured to withstand the force 706 or forces generated and applied to the load amplifier 704. For example, the spade portion 722 of the load amplifier 704, upon the force 706 being applied to the load amplifier 704, may be sized and configured to provide a static or shear force Fs as one component to withstand the force 706. In this manner, the surface area 723 of the spade portion 722 stabilizes the load amplifier 704 deep within the loose material 705. Further, the stake system 702 facilitates the tension force Ft extending along the first line 732 and the flexible line 714 between the load amplifier 704 and the stake system 702, providing another component that withstands the force 706. Such tension force Ft extends at an angle θ, thereby, providing a horizontal force component Fx and a vertical force component Fy. The distance 740 between the first coupling portion 728 and the second coupling portion 730 provides a lever arm or moment between the force 706 and the tension force Ft, the horizontal force component Fx directly counteracting the force 706. Further, upon the force 706 being applied to the load amplifier 716, the vertical force component Fy drives or forces the load amplifier 704 in a downward direction. As such, as the force 706 that is applied to the load amplifier 716 is, increased, the vertical force component Fy driving the load amplifier 716 into the loose material also is increased. With this arrangement, the distance 740 or moment arm provides an advantageous feature in providing a multiplying effect for both the horizontal force component Fx and the vertical three component Fy of the tension force Ft. Further, the stake system of the present invention provides the stability and anchoring necessary to facilitate the tension force Ft. In this manner, the combined anchoring features of the stake system 702 and the load amplifier 701 provide the high-load stake system 700 the ability to withstand large constant and/or dynamic forces in loose material, such as sand or snow.

Figure 23A:
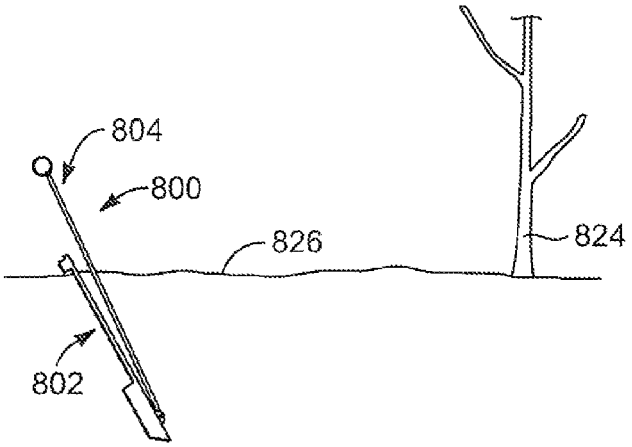
FIGS. 23A and 23B are side views of the stake system of FIG. 22, depicting method steps for installing the stake system with a rigid member, according to one embodiment of the present invention.
Figure 22:
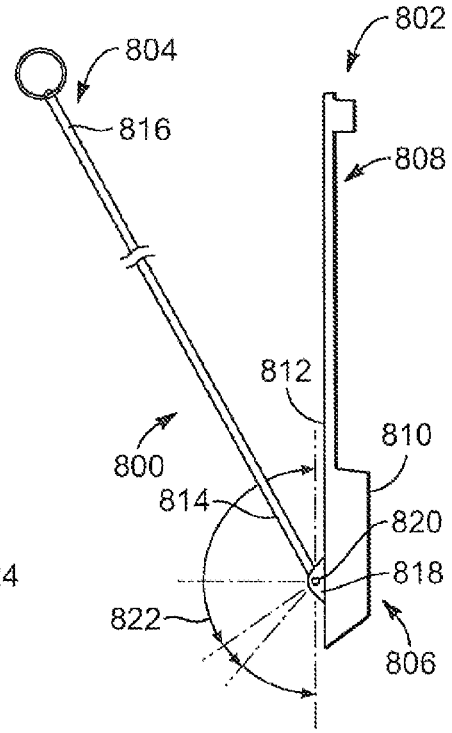
FIG. 22 is a side view of a stake system with a rigid member, according to another embodiment of the present invention.
Figure 23B:
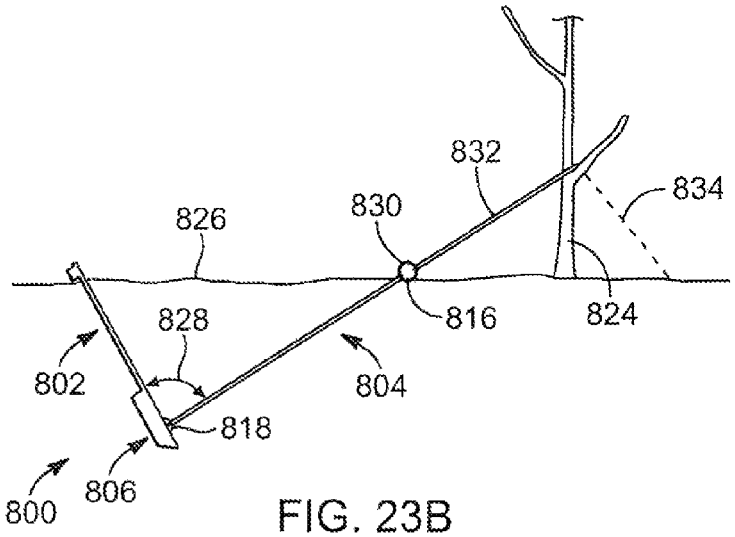

Now turning to FIGS. 22, 23A, and 23B, another embodiment of a stake system 800 is provided. Referring first to FIG. 22, the stake system 800 of this embodiment includes a rigid member 804, rather than the flexible line of previous embodiments. The stake system 800 includes a stake member 802 and the rigid member 804, the stake member 802 having a distal portion 806 and an elongated portion 808. Similar to previous embodiments, the stake member 802 may include a first side surface 810 and a second side surface 812 with a bend (not shown) extending along a longitudinal length 813 of the stake member 802, or at least partially along the length of the stake member 802. Further, the distal portion 806 and the elongated portion 808 may be integrally formed to each other as well as extend from each other in a fixed arrangement.

The rigid member 804 may be elongated with a first end portion 814 and a second end portion 816, the first end portion 814 pivotably coupled the distal portion 806 of the stake member 802 at for example, the second side surface 812 of the stake member 802. The second end portion 816 of the rigid member 804 may be a free end. The rigid member 804 may be pivotably coupled to a stake coupling portion 818 via a pin 820 and hole (not shown) type arrangement or some other coupling member as known in the art. The stake coupling portion 818 may be sized and configured to facilitate the rigid member 804 to pivot about the stake coupling portion 818 at an angle 822, relative to the stake member 802, ranging between about 0 degrees and 180 degrees, or at an angle 822 ranging between about 0 degrees and 135 degrees. The rigid member 804 may also pivot about the stake coupling portion 818 at an angle 822 ranging between about 0 degrees and 120 degrees, or any other angle range suitable to facilitate, the rigid member 804 to pivot and extend at an appropriate angle relative to the stake member 802. Further, the rigid member 804 may include a lateral cross-section having a rectangular shape or any other suitable shape, such as circular or square shape. The rigid member 804 may be formed of a metallic material, such as steel, or the rigid member 804 may be formed from a polymeric material. Further, the rigid member 804 may be elongated so as to be longer than the length 813 of the stake member 802. In another embodiment, the rigid member 804 may be elongated to be a similar length of the longitudinal length 813 of the stake member 802.

With respect to FIGS. 23A and 23B, one embodiment of installing the stake system 800 is provided. For example, with reference to FIG. 23A, the stake system 800 may be positioned adjacent an object 824, such as a tree or any other suitable object for staking down or anchoring. The stake system 800 may be pounded or manually forced into a loose material 826. such as sand or soil, with the rigid member 804 extending relative to the stake member 802 in a closed position or at an angle of about 0 degrees. In instances where one may be planting a tree or the like, the soil may be disrupted or loose. As such, the stake system 800 may be implemented in soil that may be loosened to facilitate the stake system 800 to be pounded or forced into the loose material 826.

As depicted in FIG. 23B, once the stake system 800 is positioned in the loose material 826, the rigid member 804 may then be manually moved and pivoted to an angle 828 relative to the stake member 802. Such angle 828 may extend from the stake member at about 90 degrees, or at an angle extending in the range of about 60 degrees and 120 degrees, or at an angle extending within the range of about 45 degrees and 135 degrees. in this, manner, the rigid member 804 moves through the loose material 826, pivoting about the stake coupling portion 818, such that the second end portion 816 may be exposed above the loose material 826 with the remaining portion of the rigid member 804 extending through the loose material 826 to the distal portion 806 of the stake member 802. The second end portion 816 of the rigid member 804 may include a ring portion 830 or the like. Such ring portion 830 may then be coupled to a line member 832 so that the line member 832 may be coupled to the object 824. One or more other stake system 800, if needed, may also be employed, to anchor the object 824, as represented with dotted line 834. With this arrangement, the stake system 800 having the rigid member 804 may be employed to anchor an object 824, similar to previous embodiments.

While the invention may be susceptible to various modifications and alternative forms, specific embodiments have been shown by way of example in the drawings and have been described in detail herein. Further, the structural features of any one embodiment disclosed herein may be combined or replaced by any one of the structural features of another embodiment set forth herein. For example, the tabs 490 of FIG. 12 may be included in any one of the embodiments of the elongate member described herein. As such, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A stake system configured to be used in substantially loose material to anchor an object, the stake system comprising:

a stake member having a longitudinal length extending to define an elongated portion and a distal portion, each of the elongated portion and the distal portion defining a flat structure along the longitudinal length of the stake member, the distal portion integrally formed with the elongated portion, the elongated portion being longitudinally longer than the distal portion, the distal portion defining a first lateral width and the elongated portion defining a second lateral width, the first lateral width being larger than the second lateral width; and a flexible cable configured to be coupled to the distal portion of the stake member, the flexible cable and the distal portion of the stake member configured to be below the exposed surface of the loose material, the flexible cable sized and configured to cut through the loose material such that at least a portion of the flexible cable extends tautly away from the stake member and through the loose material below the exposed surface, the flexible cable having an end configured to extend above the loose material to couple to the object;

wherein the stake member is configured to substantially maintain a constant orientation relative to the exposed surface of the loose material upon the stake member being forced into the loose material and upon the flexible cable being extended tautly away from the stake member at an angle ranging between about 45 degrees and about 135 degrees.

2. The stake system of claim 1, wherein the stake member includes a continuous bend extending along both the elongated portion and the distal portion thereof and extending along the longitudinal length of the stake member.

3. The stake system of claim 2, wherein the stake member includes multiple openings defined therein and extending through the stake member, the multiple openings aligned along the bend in both the distal portion and the elongated portion.

4. The stake system of claim 3, wherein the multiple openings are elongated openings and configured to couple to the flexible cable.

5. The stake system of claim 2, wherein the stake member is configured to be positioned in the loose material such that the bend orients the distal portion and the elongated portion to extend away from the end of the flexible cable coupled to the object.

6. The stake system of claim 2, wherein a portion of the flexible cable is configured to nest in the bend defined in the stake member.

7. The stake system of claim 1, wherein the stake member includes multiple openings defined therein and extending through the stake member, the multiple openings aligned along a center longitudinal axis in both the distal portion and the elongated portion of the stake member.

8. The stake system of claim 7, wherein the flexible cable is configured to couple to the stake member by extending through at least two of the openings.

9. The stake system of claim 7, wherein the flexible cable is configured to selectively extend through two of at least three of the multiple openings to provide a selective effective force applied to the stake member.

10. The stake system of claim 1, wherein the stake member comprises multiple coupling portions aligned along a center longitudinal axis extending along both the distal portion and the elongated portion of the stake member.

11. The stake system of claim 10, wherein the flexible cable comprises a first line portion and a second line portion, the first line portion and the second line portion each extending from separate and distinct coupling portions of said multiple coupling portions.

12. The stake system of claim 11, wherein the first line portion and the second line portion are configured to selectively couple to two of at least three of the multiple coupling portions to provide a selective effective force applied to the stake member.

13. The stake system of claim 1, wherein the flexible cable comprises a coupling member sized and configured to engage an opening defined in the distal portion of the stake member.

14. The stake system of claim 13, wherein the coupling member comprises a first opposing portion and a second opposing portion with a middle portion extending therebetween, the middle portion configured to engage the opening and the first and second opposing portions configured to be positioned at opposing sides of the stake member.

15. The stake system of claim 13, wherein the coupling member comprises a key configuration that corresponds to the opening defined in the distal portion of the stake member.

16. The stake system of claim 1, wherein the stake member tapers along a longitudinal length thereof from the distal portion of the stake member toward a proximal end of the stake member.

17. The stake system of claim 1, further comprising a load amplifier configured to be positioned in the loose material such that the flexible cable is configured to be operatively coupled to and tautly extend from the load amplifier.

18. The stake system of claim 1, wherein the distal portion extends laterally relative to the elongated portion to define a lateral extension, the lateral extension extending laterally to define the first lateral width.

19. The stake system of claim 1, wherein the stake member extends between a proximal end and a distal end, the distal end exhibiting ground penetrating structure of the stake member.

20. The stake system of claim 19, wherein the elongated portion extends proximally from the distal portion to the proximal end such that the distal portion is adjacent the distal end.

21. A stake system configured to be used in substantially loose material to anchor an object, the stake system comprising:

a stake member having an elongated portion and a distal portion, the distal portion integrally formed with the elongated portion, the distal portion configured to maintain a fixed position relative to the elongated portion, and the distal portion having a width larger than the elongated portion, the stake member including a continuous bend extending along both the elongated portion and the distal portion thereof and extending along a longitudinal length of the stake member; and a flexible cable configured to be coupled to the distal portion of the stake member, the flexible cable and the distal portion of the stake member configured to be below an exposed surface of the loose material, the flexible cable sized and configured to cut through the loose material such that at least a portion of the flexible cable extends tautly away from the stake member and through the loose material below the exposed surface, the flexible cable having an end configured to extend above the loose material to couple to the object, and the flexible cable configured to extend tautly away from the stake member and through the loose material at an angle ranging between about 45 degrees and about 135 degrees.

22. The stake system of claim 21, wherein the stake member is configured to be positioned in the loose material such that the bend orients the distal portion and the elongated portion to extend away from the end of the flexible cable coupled to the object.

23. The stake system of claim 21, wherein the stake member comprises a flat structure.

24. The stake system of claim 21, wherein each of the elongated portion and the distal portion define a flat structure along the longitudinal length of the stake member.

25. The stake system of claim 21, wherein each of the elongated portion and the distal portion define a continuous flat structure along the longitudinal length of the stake member.

26. The stake system of claim 21, wherein the elongated portion is longitudinally longer than the distal portion.

27. The stake system of claim 21, wherein the distal portion extends laterally relative to the elongated portion to define a lateral extension, the lateral extension extending laterally to define the first lateral width.

28. The stake system of claim 21, wherein the stake member extends between a proximal end and a distal end, the distal end being a ground penetrating end of the stake member.

29. The stake system of claim 28, wherein the elongated portion extends proximally from the distal portion to the proximal end such that the distal portion is adjacent the distal end.

* * * * *